United States Patent [19]

Mertes

[11] 4,125,297

[45] * Nov. 14, 1978

[54] UNIVERSAL DRAWER SLIDER

[76] Inventor: Paul M. Mertes, 15528 Don Metz St., Granada Hills, Calif. 91344

[ * ] Notice: The portion of the term of this patent subsequent to Dec. 5, 1994, has been disclaimed.

[21] Appl. No.: 857,234

[22] Filed: Dec. 5, 1977

Related U.S. Application Data

[63] Continuation-in-part of Ser. No. 704,649, Jul. 12, 1976, Pat. No. 4,061,375, which is a continuation-in-part of Ser. No. 576,349, May 12, 1975, abandoned.

[51] Int. Cl.[2] ..... F16C 21/02

[52] U.S. Cl. ..... 308/3.6; 312/348

[58] Field of Search ..... 308/3.6, 3.8, 3 R, 3 A; 312/346, 347, 341, 345, 350, 348, 330 R; 74/527

[56] References Cited

U.S. PATENT DOCUMENTS

| | | | |
|---|---|---|---|
| 3,185,530 | 5/1965 | Reiss et al. | 308/3.6 |
| 3,658,394 | 4/1972 | Guntner | 308/3.6 |
| 3,923,347 | 12/1975 | Dean | 308/3.6 |

*Primary Examiner*—Trygve M. Blix
*Assistant Examiner*—Douglas C. Butler
*Attorney, Agent, or Firm*—Poms, Smith, Lande & Glenny

[57] ABSTRACT

A universal and economical drawer slide is mounted on the rear underside of a pull drawer to engage a fixed cabinet side member or channel. The preferred embodiments disclosed in the present application are rectangular in shape and are intended for use with furniture-type drawers which have a recessed drawer back, with the thin bottom of the drawer secured into the recess in the drawer back. By making the drawer guide rectangular in configuration, it may be thinner at the rear and therefore may be used with a furniture-type drawer with a cutting away of only a short section in the center of the bottom of the drawer back. The cabinet guide members may be made of wood or of metal channels, and include laterally extending side rails which are engaged by the molded plastic drawer guide which is secured to the rear portion of the drawer. The drawer guide includes a generally rectangular flat, thin plastic body, with a flange which extends upwardly and over the outer side of the back portion of the drawer. Near the very rear of the drawer at the back of the drawer guide, it includes two laterally extending members to overly the laterally extending portions of the cabinet guide members. The plastic body also carries depending members along its length which engage the outer sides of the cabinet guides to maintain the drawer in alignment.

21 Claims, 18 Drawing Figures

UNIVERSAL DRAWER SLIDER

REFERENCE TO OTHER PATENT APPLICATIONS

This case is a continuation-in-part of my prior copending U.S. patent application No. 704,649, filed July 12, 1976, granted as U.S. Pat. No. 4,061,375 on Dec. 6, 1977. The foregoing patent was a continuation-in-part of U.S. patent application Ser. No. 576,349, filed May 12, 1975 and now abandoned.

FIELD OF THE INVENTION

This invention relates to drawer slides and more particularly to novel universal drawer slides which are particularly applicable to cabinet type drawers.

BACKGROUND OF THE INVENTION

In the past, it has been the conventional practice to employ slide members on the underside of a drawer for slidably engaging a channel so that the drawer may be pulled or drawn easily from its storage cavity in a cabinet. Although a variety of slides are known for movably supporting a drawer on a channel, problems have been encountered which stem largely from the fact that the drawer is not supported firmly enough to prevent lateral displacement, or tilting, during movement of the drawer. Also, prior art drawer slides sometimes take the form of a number of components which must be separately and carefully installed in order to obtain the designed alignment and registry between coöperating members. Such a multiplicity of component parts is expensive to manufacture and difficult to assemble and install.

Other known drawer slides extend the full length of the drawer and have special molded components at each end thereof; accordingly, they must be specially made to fit each of the many different drawer lengths. With the cost of injection molds running in the order of several thousand dollars per mold, such previously proposed full length drawer slides are totally impractical and have never come into widespread use.

Therefore, there has been a longstanding need to provide a simple universal slide for drawers which is formed in one piece, and which is simply and inexpensively installed, and which positively prevents wobble or lateral misalignment of the drawer.

In the field of furniture drawers, the drawer back, as well as the sides, are normally recessed by a "dado" blade, or the like, and the relatively thin bottom of the drawer is normally secured in this recess. In the case of drawer slides for this type of cabinet drawer, it is undesirable to cut away the lower rear edge of the drawer to a substantial extent, as this would be relatively costly, and reduce the strength of the drawer. Accordingly, another object of the present invention is to provide a universal drawer slide for furniture-type drawers having recessed drawer backs in which the drawer bottom is secured.

BRIEF SUMMARY OF THE INVENTION

In accordance with a specific illustrative embodiment of the invention, a universal one piece drawer slide for furniture-type drawers is of relatively narrow, generally rectangular configuration, with a flange which extends upwardly over the back of the furniture-type drawer. The drawer slide is relatively short, less than the length of the drawer, so that it may be used with drawers with difference lengths. In view of the relatively narrow width of the drawer slide, the back of the cabinet drawer only needs to be cut away for a relatively short distance toward the center bottom of the drawer back. The drawer slide includes laterally extending projections at the rear of the drawer slide to engage the laterally extending side rails of the cabinet drawer guide which is fixedly secured to the cabinet. Along its length and extending forwardly, the drawer guide also includes arrangements for engaging the side of the cabinet drawer guide, thereby preventing lateral misalignment of the guide.

In accordance with another feature of the invention, the drawer slide may have laterally extending projections only at its rearmost end. With this construction, less elaborate molds are required, and the units can therefore be made less expensively.

In accordance with another feature of the invention, the drawer slide may be provided with an integral selectively releasable depending hook, which provides a positive stop preventing the drawer from accidentally being moved out of its cabinet.

In accordance with a broad aspect of the invention, a universal drawer slide has a length of less than one foot in order to be applicable to any normal drawer. In addition, the drawer slide is provided with a flange to extend over the bottom rear of the drawer for accurate positioning. Further, the drawer slide includes members along its length closely aligned with the spacing of the cabinet drawer guide to prevent lateral misalignment, and also at its rear end the drawer slide includes laterally extending projections to engage the corresponding laterally extending rails of the cabinet drawer guide. By providing relatively close tolerances between the drawer slide and the sides of the cabinet drawer guide, lateral misalignment may be precluded without the need for having the drawer guide extend for the full length of the drawer, with a consequent loss of universality of application.

In accordance with another feature of the invention, the drawer slides may be provided with plastic blocks toward the front end of the drawer slide, to receive fasteners such as staples extending through the thin drawer bottom to secure the front end of the drawer slide in position. The flange at the rear of the drawer slide may also be secured to the drawer back by fasteners such as staples. To give an indication of the dimensions and tolerances which are involved, the normal cabinet drawers are about 22 inches in length, but may vary by plus or minus 6 inches, for example, for special purposes. Many drawers, however, are of lesser depth, with 15 or 16 inch drawers frequently being found in dressers. Accordingly, in order for a single unitary drawer slide to be universally applicable, it should be shorter than dresser drawers and would thus be less than one foot in length. In practice, it has been determined that a full foot in length is not required in order to prevent side play. In practice the inventors have determined that the preferred optimum length is in the order of about 6 to 9 inches. Similarly, with regard to width, the normal cabinet guide rail ranges from about $\frac{3}{4}$ of an inch to $1\frac{1}{2}$ inch in width. In the rectangular form of guide with a substantially constant width over its length, it has been determined that the width should be from about $1\frac{1}{2}$ to 4 inches, with a width of between 2 and 3 inches being preferred to give adequate strength and to keep the amount of plastic and the required cut in the drawer back to a minimum. The cabinet guides are normally held to tolerances in the order of 0.001 inch or 0.002 inch. The guiding portions of the drawer slide are held to within approximately 0.02 or 0.01 inch tolerances; and assuming that the drawer is three times the length of the drawer slide, this means that the lateral movement of the drawer is held to about 1/16th of an inch, and normally to less than this figure.

In addition to the rectangular form of the invention, the drawer slide configuration in which positive vertical interengagement between the drawer slide and the cabinet guide occurs only at the rear end of the drawer guide, may be implemented by a triangular shaped drawer slide in which the rear of the slide, particularly the flange which overlies the back of the drawer, is of greater width than the front of the drawer slide.

In accordance with a most important feature of the invention, an economical and universal drawer slide is provided, with a single slide fitting all normal drawer sizes.

An additional feature of the invention is the controlled and smooth effortless drawer action resulting from the small surface area of the short drawer slide in engagement with the mating channel.

Other objects, features, and advantages of the invention will become apparent from a consideration of the following detailed description and from the accompanying drawings.

DETAILED DESCRIPTION

Figure 1:
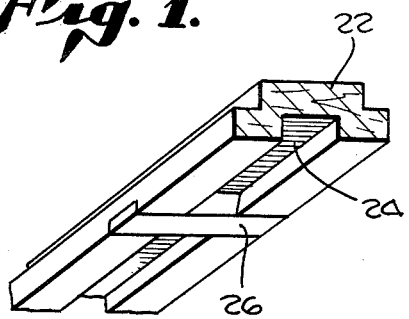
FIG. 1 is a isometric view of a wooden cabinet guide member for a drawer.
Figure 2:
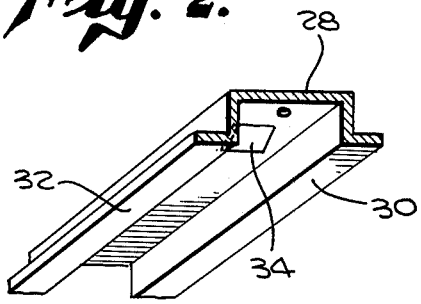
FIG. 2 shows a metal cabinet drawer guide with outwardly directed flanges for engaging a drawer slide.
Figure 3:
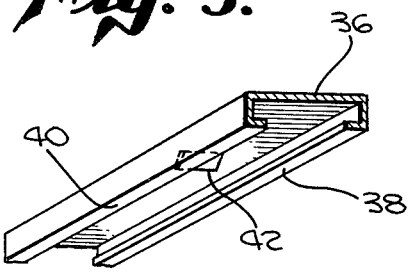
FIG. 3 is an isometric view of a metal cabinet drawer guide with inwardly directed flanges.

Referring more particularly to the drawings, the first three figures of the drawings show various forms of cabinet guide members or channels. FIGS. 1 through 3 are shown inverted as compared to their normal orientation as used in furniture or cabinets. FIG. 1 is made of a strip of wood 22 of T-shaped cross section and having an upper groove 24. A transverse stop member 26 near the front end of the cabinet guide member 22 serves to stop forward movement of the drawer and prevent it from coming all the way out of its associated cabinet through cooperation with the drawer slide member as discussed below.

FIGS. 2 and 3 both show metal cabinet guide members with guide member 28 of FIG. 2 being provided with outwardly extended flanges 30 and 32 together with a stop member 34 serving much the same function as the transverse stop member 26 of FIG. 1. In FIG. 3 the guide member 36 is provided with inwardly directed flanges 38 and 40 and a stop 42.

Figure 4:
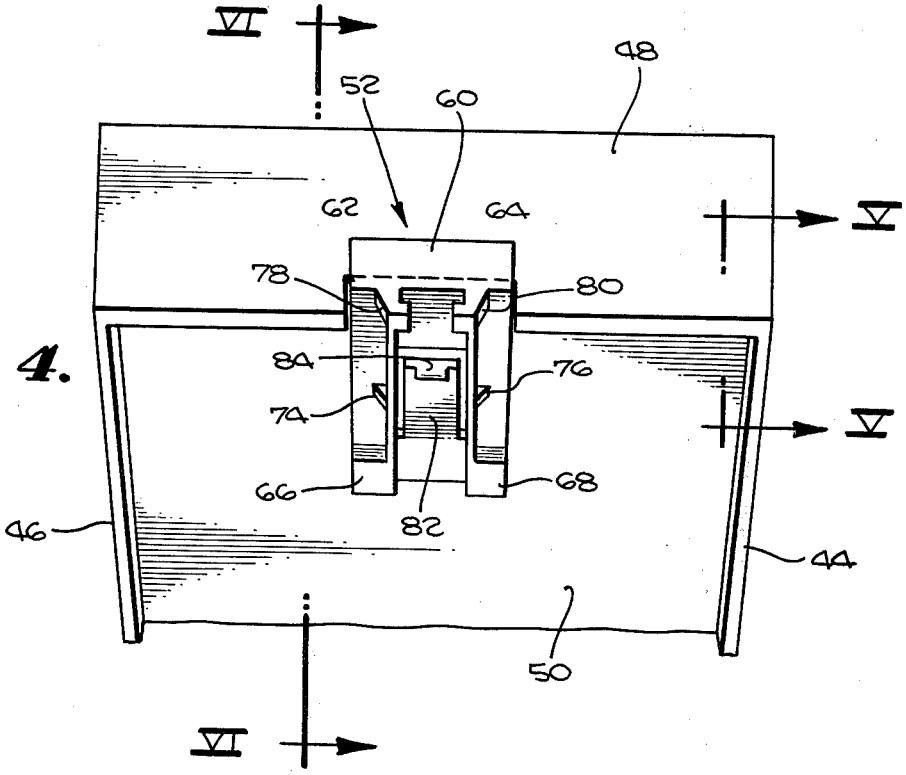
FIG. 4 shows a rear view of a cabinet type drawer equipped with an illustrative drawer slide in accordance with the present invention.

FIG. 4 shows a furniture-type drawer in which the two sides 44 and 46, as well as the rear 48, extend below the bottom 50 of the drawer.

Figure 5:
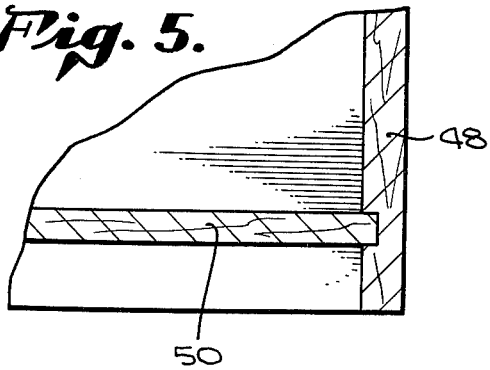
FIG. 5 is a cross sectional view taken along lines V—V of FIG. 4.
Figure 6:
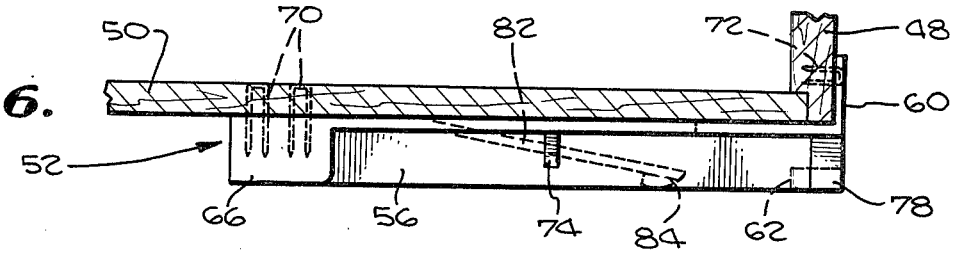
FIGS. 6 through 9 are various views of the drawer slide shown in FIG. 4, with FIG. 6 being taken along VI—VI of FIG. 4.

As clearly shown in FIG. 5, in this type of furniture drawer, it is customary to recess the drawer body 50 into the rear 48 and the sides 44, 46 and to glue the drawer bottom 50 into place.

In my prior co-pending application, Ser. No. 704,649, filed July 12, 1976, now U.S. Pat. No. 4,061,375, granted Dec. 6, 1977, principal attention was directed to a form of the invention using triangular drawer slides. For use with furniture-type drawers, however, where the rear of the drawer is recessed and the drawer bottom is glued into this recess, the triangular or delta-type drawer slide requires the removal of more of the bottom rear of the drawer back than is desired. Accordingly, for such applications, a thinner rectangular drawer slide is to be preferred. In addition, the thinner rectangular form of drawer slide is more economical to produce, because it uses less plastic and smaller molds. Also, the drawer backs are approximately ⅜ inch thick and therefore may not provide enough material for stapling or securing the delta-type guides into the bottom of the drawer at the rear thereof, as disclosed in the prior case.

Continuing with the detailed description of the drawings, the drawer slide 52 of FIG. 4 is shown in detail in FIGS. 6 through 9. Incidentally, the drawer slides of the present invention are made of any suitable plastic or material having a high strength-to-weight ratio. High density polyethylene may be employed, for example, for its toughness and self-lubricating qualities. Other known high strength plastic or other materials may also be employed.

Referring in detail to FIGS. 6 through 9, the drawer slide 52 includes a flat body portion 54, from which a pair of longitudinal ribs 56 and 58 extend to engage the sides of one of the cabinet guides as shown in FIGS. 1 through 3. In addition, at the rear of the body 54 a flange 60 is provided which extends upwardly to overly the rear portion 48 of the drawer as shown in FIG. 4, for example. The drawer slide 52 of FIGS. 6 through 9 is intended for use with a cabinet guide member of the type shown in FIG. 1 or FIG. 2, in which outwardly extending flanges are provided. More specifically, it may be noted in the end view of FIG. 9 that two inwardly directed projections 62 and 64 are provided to overly the T-shaped cabinet guide members, and to positively preclude lifting up of the rear of the drawer off the cabinet guide members. The alignment of the drawer with the opening in the cabinet is assured by the inner surfaces of the ribs 56 and 58 engaging the two side surfaces of the cabinet guide members as shown in FIGS. 1 and 2.

For purposes of securing the drawer slide 52 to the bottom of the drawer, blocks 66 and 68 may be integrally molded into the drawer slide 52. Through the use of a template for accurate location, the staples 70 may be stapled through the wooden bottom 50 of the drawer into these blocks 66, 68, to firmly secure them in position. In addition, also as shown to advantage in FIG. 6, the rear flange 60 may be secured into the back 48 of the drawer by staples 72.

Webs or gussets of plastic material 74, 76, 78 and 80 may be provided to reinforce the central guiding ribs 56 and 58, as well as the inwardly directed projections 62 and 64.

Figure 7:
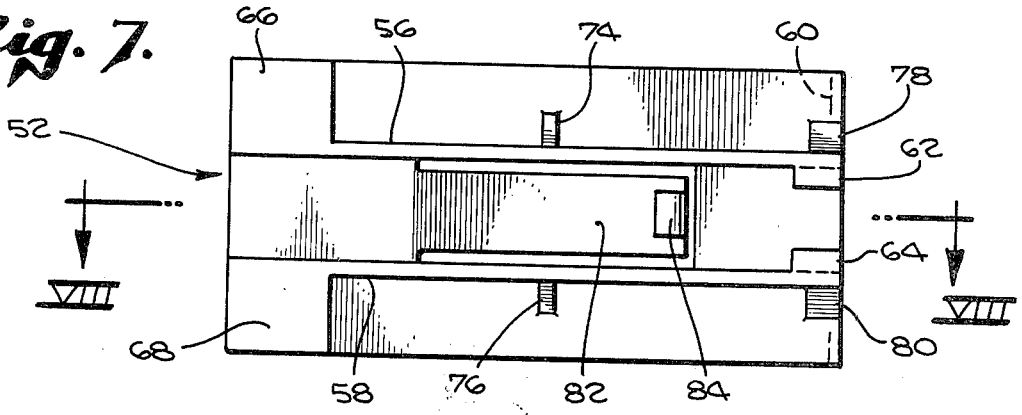
Figure 8:
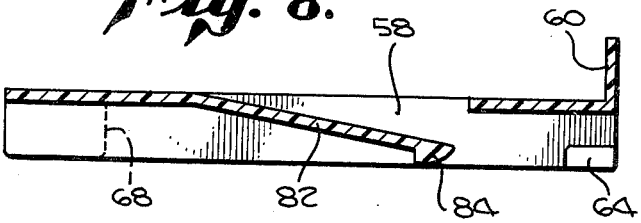
Figure 9:
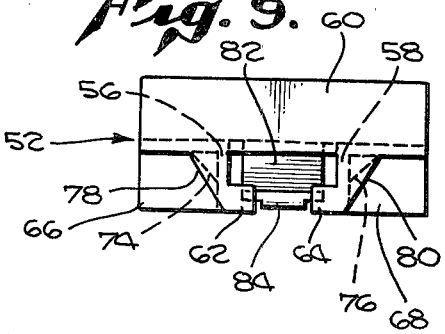

FIG. 8 is taken along lines VIII—VIII of FIG. 7, and shows the hook 82 with the positive detent 84 to engage the stop 26 of FIG. 1 or the stop 34 of FIG. 2. The width of the flexible member 82 may be approximately ½ inch in order to facilitate engagement by a person's finger and release of the detent 84. However, the positive detent 84 may be slightly reduced in width, to about ¼ inch, where desirable to permit the use of a narrower groove 24, as shown in FIG. 1.

In considering the mode of operation of a drawer equipped with the slide 52 as shown in FIG. 4 and FIGS. 6 through 9, when the drawer is pulled most of the way out of the cabinet, there would be a normal tendency for the weight of the front of the drawer to cause the drawer to tilt downwardly. This is precluded in accordance with the invention, by the inwardly directed projections 62 and 64. Also, before the drawer is pulled out far enough to cause irresistible pressure on the projection 62 and 64, the drawer is stopped by the engagement of the stop 84 on one of the projections 26 or 34, as shown in FIGS. 1 or 2. The drawer may then, of course, be released by the application of pressure on the depending member 82 to which the positive detent 84 is secured. Also, when the drawer is being pulled out in normal use, the front edge of the drawer may be lifted by the user as the handles are pulled. The drawer slide of the present invention permits such slight upward movement of the drawer, with full engagement still being maintained at the very rear of the drawer by the inwardly directed projection 62 and 64, and with the inside surfaces of the ribs 56 and 58 continuing to engage the outer sides of the cabinet guides for at least most of the length of ribs 56, 58. Accordingly, when the drawer is permitted to drop down into its normal position, the ribs 56 and 58 ensure the proper repositioning and alignment of the drawer.

Figure 10:
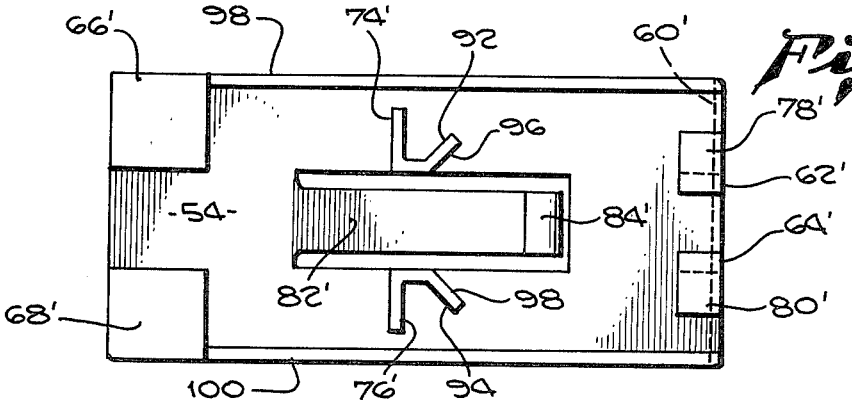
FIGS. 10 through 12 are various views of an alternative illustrative embodiment of the invention.
Figure 11:
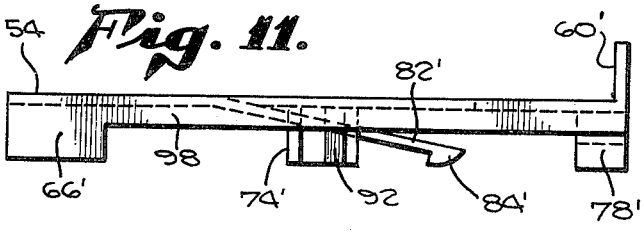
Figure 12:
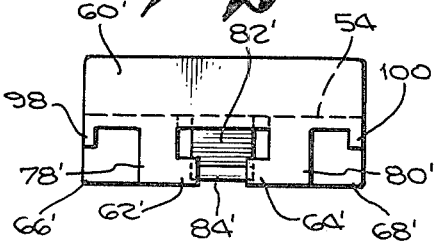

An alternative form of drawer slide is shown in FIGS. 10 through 12. The arrangement of FIGS. 10 through 12 is similar in many respects to the drawer slide of FIGS. 6 through 9, and primed reference numerals are employed in FIGS. 10 through 12 to indicate parts which conform to those shown in the embodiment of FIGS. 6 through 9. Thus, for example, the stapling blocks 66′ and 68′ of FIGS. 10 through 12, conform to the similar stapling blocks 66 and 68 of FIGS. 6 through 9. Of course, the inner surfaces of the stapling blocks 66′ and 68′ also serve a drawer guiding function, as is evident from the physical configuration.

The principal difference between the two embodiments of the invention is that the embodiment of FIGS. 10 through 12 employs the central guiding members 92 and 94 in place of the continuous longitudinally extending ribs 56 and 58 of FIGS. 6 through 9. It may be noted that the front surfaces 96 and 98 of the guide members 92 and 94 provide a guiding input for the end of the cabinet guide members, to ensure proper tracking and alignment of the drawer after the inwardly directed projections 62′ and 64′ engage the outer end of the cabinet guide and the drawer is inserted into position so that the inner surfaces of the guide members 92 and 94 engage the outer surfaces of the cabinet guide members, and thereafter a similar engagement by the blocks 66′ and 68′ occur as the drawer is advanced into its closed position.

In another minor departure from the structure of the embodiment of FIGS. 6 through 9, outer ribs 98 and 100 are provided to give increased stiffness and strength to the molded plastic body.

Figure 13:
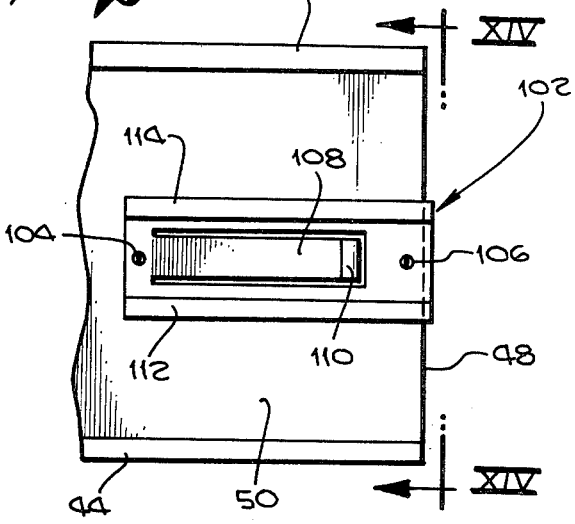
FIGS. 13 and 14 are assembly views of another embodiment of the invention intended for use with a cabinet guide member of the type shown in FIG. 3.
Figure 14:
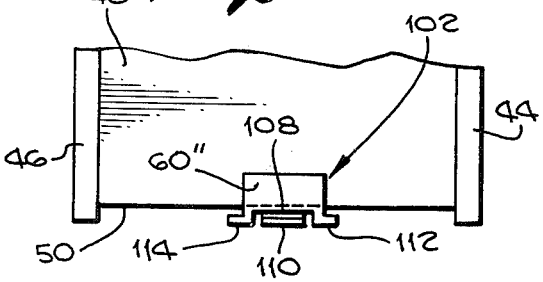

Another embodiment of the invention is shown in FIGS. 13 and 14 of the drawings, and these figures correspond respectively to FIGS. 7 and 8 of my prior co-pending case, cited hereinabove. A rectangular body or member 102 is used with a pair of screws 104 and 106 for mounting and stability. As mentioned above, a smaller amount of material is used, as compared with the triangular-shaped drawer guides of the type disclosed in the prior patent cited above, and in other embodiments of the invention to be disclosed below. This version of FIGS. 13 and 14 includes a resilient strip 108 with a hooked end 110 and guides 112 and 114. It also includes the member 60″ which overlies the rear of the drawer and extends upwardly along the rear surface of the drawer. It may be noted that the side rails 112 and 114 of the embodiment of FIGS. 13 and 14 is intended for use with the cabinet guide arrangement of the type shown in FIG. 3, in which the flanges 38 and 40 are inwardly directed. In addition, the side rails 112 and 114 extend for the full length of the rectangular member 102. Instead of extending for the full length of the drawer slide, however, the member 102 could have the side rails 112 and 114 only engage the cabinet guide member 36 of FIG. 3 at the extreme rear portion of the drawer slide portion 102, with the remainder of the outwardly extending edges of the rails 112 being eliminated, and leaving only vertically extending ribs to maintain drawer alignment by engagement with the inner surface of the inwardly directed edges 38 and 40 of the cabinet guide member.

Figure 15:
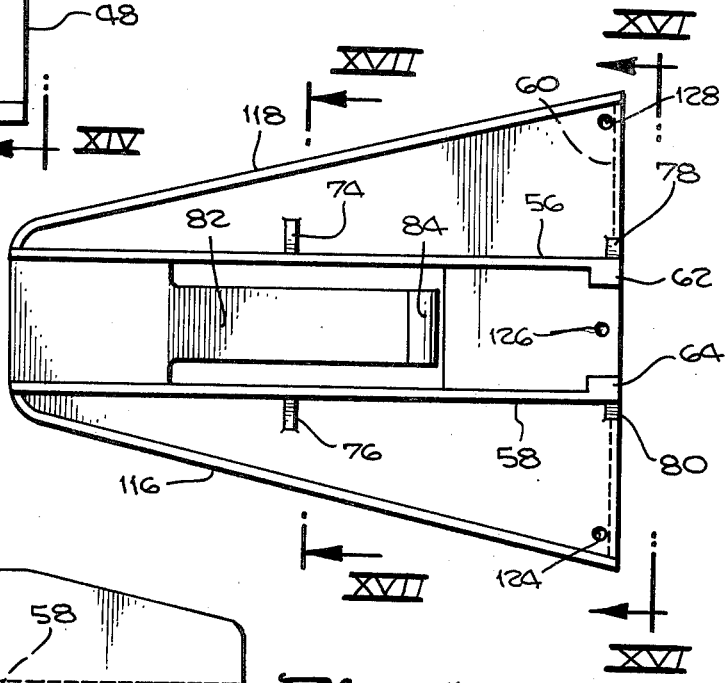
FIGS. 15 through 17 are three views of a further illustrative embodiment of the invention in which the drawer slide is generally triangular or "delta" shaped.
Figure 16:
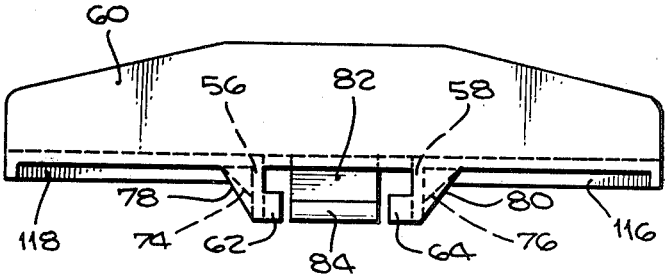
Figure 17:
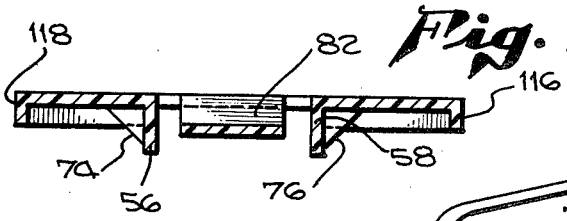

The embodiment of FIGS. 15, 16 and 17 is similar to that of FIGS. 6 through 9, but utilizes an overall triangular, or "delta" configuration, instead of the rectangular form of FIGS. 6 through 9. In FIGS. 15 through 17, reference numerals corresponding to those in FIGS. 6 through 9 will be employed to designate corresponding elements. In addition to the triangular or delta shape, of the drawer slide of FIGS. 15 through 17, the principal difference lies in the provision of an additional outer web 116 and 118 on the two sides of the drawer slide.

Figure 18:
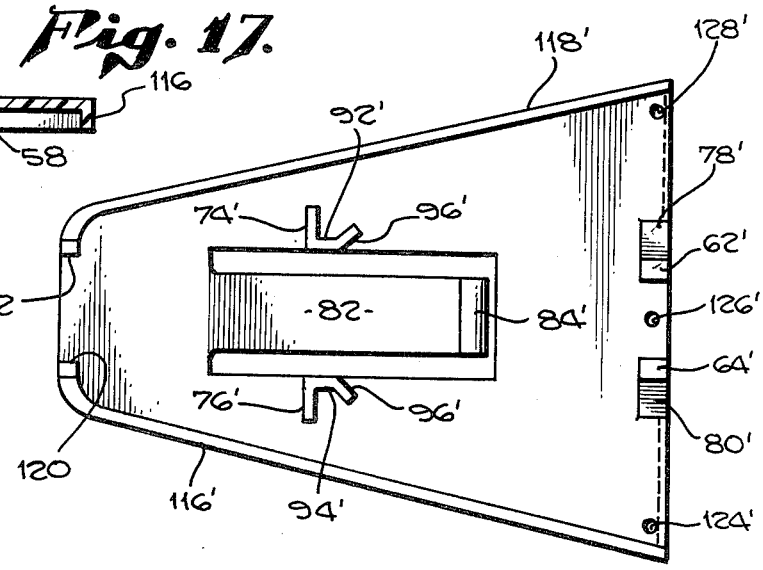
FIG. 18 is a view of still another illustrative embodiment of the invention.

Similarly, the embodiment of FIG. 18 is comparable to that of FIGS. 10 through 12, and also includes the outer web elements 116′ and 118′ to provide additional structural rigidity of the type mentioned above in connection with FIGS. 15 through 17. Again, reference numerals from the embodiment of FIGS. 10 through 12 are embployed to indicate comparable elements of the embodiment of FIG. 18. Apart from the features previously shown in other figures of the drawing, the embodiment of FIG. 18 includes the raised and enlarged guide elements 120 and 122 which are located at the forward end of the strengthening webs 116′ and 118′. The guiding elements 120 and 122 serve substantially the same function as the inner surfaces of the blocks 66′ and 68′ in FIG. 10. Accordingly, their inner surfaces are perpendicular to the main body portion of the drawer slide of FIG. 18 and they have substantially the same separation as the elements 92′ and 94′, and the opening below the inwardly directed projections 62′ and 64′ at the rear of the drawer slide.

With regard to the securing of the embodiment of FIGS. 15 through 17, and that of FIG. 18 to the drawer, three holes 124, 126 and 128 are shown for securing the "delta" type guides to the rear of the drawer. Screws may be used through the holes 124, 126 at 128 to secure the delta slide in place. In addition, staples may be employed to secure the upwardly extending web 60 to the rear of the drawer, and staples may also be employed in place of the screws to hold the delta slide to the rear bottom surface of the drawer. In view of the strength provided by the wide rear portion of the generally triangular guide member of FIGS. 16 through 17, and 18, it is not necessary to secure the front portion of the delta drawer slide to the bottom of the drawer. However, if desired, staple blocks of the type shown in the earlier figures of the drawings may be provided and the front end of the delta shaped slide may also be secured in place.

The present invention will now be reviewed and considered in connection with known prior art references. By way of background, prior patents include: R. H. Reiss U.S. Pat. Nos. 3,185,530, granted May 25, 1965, which shows a complex full length drawer slide which must be molded for the exact drawer length; C. J. Dean 3,923,347, granted Dec. 2, 1975, which shows a drawer locking mechanism operative at the rear of a drawer assembly; and K. H. Gutner 3,658,394, granted Apr. 25, 1972, showing two sheet metal members forming an "overcomeable stop" in a slide assembly extending the full length of a drawer.

In the following paragraphs, some general features, improvements, and advantages of the invention will be recapitulated and reviewed in the light of the above prior patents, and commercial drawer construction techniques. Specifically, the system of the invention provides a drawer guide means that substantially eliminates side play and tipping of the drawer in relation to the cabinet or piece of furniture in which it is installed. It permits quick mounting and fastening of the guide to the drawer, and by virtue of its unique shape and self rigidizing structure, allows for very economical manufacturing. It can be readily and reliably molded from a self lubricating plastic which provides for a smooth and quiet operating function when sliding in a metal channel attached to a cabinet or furniture structure. An integral resilient stop arrangement is provided which is a positive, manually released device, not merely a warning device.

By their very nature, many of the known drawer guide systems do not adequately provide arrangements to eliminate undesirable side play in a drawer unit unless a substantial amount of time is spent in adjusting rollers, or shimming to make a drawer precisely fit the opening. Even then, as the drawer is pulled further from its opening, wobble and side play increase in proportion, or more than proportionately to the withdrawal.

The guide of the present invention, because of the flange and short length, can be easily squared with the rear of the drawer back, and a centering jig can be used to center it between the drawer sides prior to fastening. Also, since the universal guide does not fasten to the drawer front as do full length drawer guides, the machining which would be required in some types of drawer construction, to accept the full length drawer guide is eliminated. Some prior art drawer guide systems, such as that shown in the Reiss patent, have used full length guide members on the drawer with fairly loose tolerances between the cabinet member and drawer member for most of the length of the drawer, and have relied on alignment nubs at the front end of the full-length drawer slide member to make frictional contact or close contact with the cabinet guide member secured to the cabinet, to eliminate side play. Therefore, as mentioned earlier, the drawer has a fair amount of wobble when extended and only upon closing does it prevent side play.

Further, the full length guides, such as that shown by Reiss, characteristically require structure at the front end of the drawer slide, such as the "homing" or "alignment" nubs mentioned above, the specific structure such as the flange extending up the rear of the drawer back at the rear, in order for the drawer slide to operate properly. Accordingly, in view of the specialized structure employed at the rear of the drawer slide and also at the front of the drawer slide, each drawer slide must be tailor made to the proper length, and no concept of universality for different drawer lengths is disclosed. With plastic injection molds costing several thousand dollars, and more, for moldings of the size needed for full length drawers, it is not surprising that full length drawer slides have not been widely used up to the present.

The new guide, because of its small size relative to the full length drawer guide, permits the securing of a very accurate part from an injection molding process. The tolerance between the guide and steel channel that the guide slides in, its normally approximately 0.005 inch and does not exceed 0.01 inch or 0.02 inch. The matching steel guide may be held to about 0.001 inch tolerances. Since the guide is only about 7 inches in length and an average size drawwer for a kitchen cabinet is 21 inches, this 0.005 inch will be multiplied about three times to approximately 0.015 inch to 0.018 inch at the drawer front, and not more than 1/16 inch or about 0.06 inch in the worst case.

This provides a drawer with a sufficiently low side play tolerance for the highest quality cabinet and furniture applications and in addition, keeps the drawer tracking straight throughout its length. In view of its small size and weight, the guides can be molded from a thermoplastic material for a fraction of the cost of full length systems. Also, because of its size, it can be molded to closer tolerances than larger sizes which of necessity must have larger tolerances due to warpage of materials of this type when they are of substantial length (such as the Reiss guide).

An additional advantage is that the new guide will fit all drawer depths due to its smaller size. This results in a great savings in manufacturing and also for the cabinet or furniture manufacturer since he does not have to inventory a multiplicity of different drawer slide lengths. Particularly for the custom manufacturer who builds cabinets of all depths, all that is necessary is to cut the mating steel channel to the cabinet depth required. In the case of the full length drawer guide of Reiss, for example, if this were attempted on the drawer guide member, some function of the guide would have to be cut off in order for it to fit a shorter drawer. The universal applicability of a single guide becomes particularly important when the several thousand dollar cost of a single injection molding die is considered, as mentioned above. Thus, the savings achieved extend from manufacturing, through inventory and simplified manufacturing operations.

An additional feature of the new slide, which is an inherent part of its structure is that, when a drawer is picked up at the front, the front of the slide will still engage the sides of the cabinet guide at least in part, so that alignment is maintained. The drawer still maintains lateral stability and the drawer slide cannot be untracked from the cabinet guide and the cooperative positive stop arrangements. With regard to the stop arrangements shown in the Reiss and Gutner patents, their "stops" are essentially warning devices of either a frictional or resilient nature. They are both devices which can be overcome by a sustained pull, or lifting the front a small amount, and all are marginal as far as a positive stopping is concerned. As an example, a child who is not mindful of the warning device could pull the drawer out, with danger to himself. Also, for recreational vehicles such as mobile homes and campers, drawers equipped with the present invention could not be shaken out of the cabinet by vibration or acceleration while the vehicle is in motion. The stop device does not require any additional cost to manufacture. After the drawer has been removed reinsertion is easy as the cammed end of the cantilevered plastic strip readily overrides the upstanding metal tab in the steel cabinet guide or the stop in the wooden guide. The drawer may be withdrawn at will be merely pressing on the exposed cantilevered strip of the drawer slide so that the right angle abutting surface clears the cabinet guide stop. The drawer can then be slid out of the drawer opening without any pulling or lifting up of the drawer front to clear a projection as is required in some prior art arrangements.

An additional feature, contributing to smooth and effortless drawer action, is the small surface area of the guide rails in contact with the slide channel as compared to other full length systems, such as that of Reiss, which use molded-in areas to reduce frictional contact between the cabinet channel and drawer guide.

In conclusion, while particular embodiments of the present invention have been shown and described, it will be obvious to those skilled in the art that changes and modifications may be made without departing from this invention in its broader aspects, and therefore, the intent of the appended claims is to cover all such changes and modifications as fall within the spirit and scope of this invention.

What is claimed is:

1. An economical universal drawer slide assembly comprising:

a fixed cabinet guide member having transversely extending side rails, having a predetermined length, having a groove extending for most of its length, said groove terminating in a positive stop near the front of said cabinet guide member;

a drawer having a depth from front to rear substantially equal to the length of said cabinet guide member;

a generally rectangular drawer slide body having a width slightly greater than said cabinet guide member, and a length less than two-thirds of the length of said guide member;

an integral flange extending at right angles from one end of said drawer slide body and overlying the rear of said drawer;

means for securing the front end of said slide body to an intermediate point on the bottom of a drawer;

means for securing the rear of said slide body to the rear of a drawer;

means including two laterally extending members integrally secured to said drawer slide body for engaging the transversely extending side rails of the cabinet guide member at the rear of said drawer slide, means located along the length of said drawer slide body for engaging the cabinet guide member for maintaining the drawer slide member in alignment with the cabinet guide member; and a selectively releasable depending hook means integral with said slide body for normally riding in said groove, and for engaging said stop on said cabinet guide, to positively prevent accidental movement of said drawer slide out of engagement with said cabinet guide.

2. A universal drawer slide assembly as defined in claim 1 wherein said slide is less than one foot in length, and less than four inches in width.

3. A universal drawer slide assembly as defined in claim 1 wherein said drawer has a recessed drawer back, the bottom of said drawer is secured into said recessed drawer back, and a short section of the back rear of said drawer is cut away to receive said drawer slide.

4. A universal drawer slide assembly as defined in claim 1 wherein said drawer slide is less than ten inches in length and is three inches or less in width.

5. A universal drawer slide assembly as defined in claim 1 further comprising:

plastic blocks integrally secured to the forward end of said drawer slide; and driven fastener means extending from the inside of said drawer into said blocks.

6. A universal drawer slide assembly as defined in claim 5 further comprising driven fastener means securing said flange to the back of said drawer.

7. An economical universal drawer slide for use with a cabinet guide member having transversely extending side rails comprising:

a generally rectangular drawer slide body having a width slightly greater than the cabinet guide member with which it is to be used;

an integral flange extending at right angles from one end of said drawer slide body for overlying the rear of the drawer to which it is to be secured;

means for securing the front end of said slide body to an intermediate point on the bottom of a drawer;

means for securing the rear of said slide body to the rear of a drawer;

means including two laterally extending members integrally secured to said drawer slide body for engaging the transversely extending side rails of the cabinet guide member; and means located along the length of said drawer slide body for engaging the cabinet guide member for maintaining the drawer slide member in alignment with the cabinet guide member.

8. A universal drawer slide as defined in claim 7 further comprising a selectively releasable depending hook integral with said slide body for engaging a stop on said cabinet guide, to positively prevent accidental movement of said drawer slide out of engagement with the cabinet guide member.

9. A universal drawer slide as defined in claim 7 wherein said slide is less than one foot in length, and less than four inches in width.

10. A universal drawer slide as defined in claim 7 further comprising block means integral with said slide means and located toward the front of said slide body for receiving fastening means for securing the front end of said slide to said drawer.

11. An economical universal drawer slide for use with a cabinet guide member having transversely extending side rails comprising:

a drawer slide body having a length which is less than one foot;

an integral flange extending at right angles from one end of said drawer slide body for overlying the rear of the drawer to which it is to be secured;

means for securing said slide body securely to the bottom of a drawer including means for securing the rear of said slide body to the rear of a drawer;

means including two laterally extending members integrally secured to said drawer slide body for engaging the transversely extending side rails of the cabinet guide member; and means located along the length of said drawer slide body for engaging the cabinet guide member for maintaining the drawer slide member in alignment with the cabinet guide member.

12. A universal drawer slide as defined in claim 11 further including selectively releasable hook means depending from and extending toward the rear from said slide body for positively stopping the movement of the drawer to which said slide may be secured.

13. A universal drawer slide as defined in claim 11 further comprising fastening blocks integrally secured to the front end of said drawer slide body for receiving driven fasteners passing through the drawer.

14. A universal drawer slide as defined in claim 11 wherein said slide body is generally triangular in shape, and means are provided for securing said slide body to a drawer only at the rear of said slide and said drawer.

15. A universal drawer slide as defined in claim 11 wherein said slide is less than nine inches in length.

16. An economical universal drawer slide assembly comprising:

a fixed cabinet guide member having transversely extending side rails and having a predetermined length;

a drawer having a depth from front to rear substantially equal to the length of said cabinet guide member;

a drawer slide body having a width greater than said cabinet guide member, and a length less than two-thirds of the length of said guide member and of said drawer;

an integral flange extending at right angles from one end of said drawer slide body and overlying the rear of said drawer;

means for securing said slide body to the bottom of said drawer including means for securing the rear of said slide body to the rear of said drawer;

means including two laterally extending members integrally secured to said drawer slide body for engaging the transversely extending side rails of the cabinet guide member; and means located along the length of said drawer slide body for engaging the cabinet guide member with a tolerance of 0.02 inch or less for maintaining the drawer slide member in alignment with the cabinet guide member.

17. A universal drawer slide as defined in claim 16 further including selectively releasable hook means depending from and extending toward the rear from said slide body for positively stopping the movement of the drawer to which said slide may be secured.

18. A universal drawer slide as defined in claim 16 further comprising fastening blocks integrally secured to the front end of said drawer slide body for receiving driven fasteners passing through the drawer.

19. A universal drawer slide as defined in claim 16 wherein said slide body is generally triangular in shape, and means are provided for securing said slide body to a drawer only at the rear of said slide and said drawer.

20. A universal drawer slide as defined in claim 16 wherein said slide is less than twelve inches in length.

21. A universal drawer slide as defined in claim 16 wherein said means for maintaining said drawer slide member in alignment with the cabinet guide member includes separate protrusions on said slide body with slanted surface means facing the rear of said slide to facilitate initial assembly of said slide to said cabinet guide.

* * * * *

REEXAMINATION CERTIFICATE (1467th)

United States Patent [19] [11] B1 4,125,297

Mertes [45] Certificate Issued May 21, 1991

[54] UNIVERSAL DRAWER SLIDER

[75] Inventor: Paul M. Mertes, Granada Hills, Calif.

[73] Assignee: GWN Inc.

Reexamination Request:
No. 90/001,918, Dec. 27, 1989

Reexamination Certificate for:

| | |
|---|---|
| Patent No.: | **4,125,297** |
| Issued: | **Nov. 14, 1978** |
| Appl. No.: | **857,234** |
| Filed: | **Dec. 5, 1977** |

Related U.S. Application Data

[63] Continuation-in-part of Ser. No. 704,649, Jul. 12, 1976, Pat. No. 4,061,375, which is a continuation-in-part of Ser. No. 576,349, May 12, 1975, abandoned.

[51] Int. Cl.[5] ..... A47B 88/00; A47B 95/00; F16C 21/02

[52] U.S. Cl. ..... 312/348

[58] Field of Search ..... 312/348, 348.1-348.5, 312/346, 341.1, 344, 343, 330.1; 384/20, 21, 22, 23

[56] References Cited

U.S. PATENT DOCUMENTS 3,185,530 5/1965 Reiss et al. .
3,477,770 11/1989 Niemi .

*Primary Examiner*—Douglas C. Butler

[57] ABSTRACT

A universal and economical drawer slide is mounted on the rear underside of a pull drawer to engage a fixed cabinet side member or channel. The preferred embodiments disclosed in the present application are rectangular in shape and are intended for use with furniture-type drawers which have a recessed drawer back, with the thin bottom of the drawer secured into the recess in the drawer back. By making the drawer guide rectangular in configuration, it may be thinner at the rear and therefore may be used with a furniture-type drawer with a cutting away of only a short section in the center of the bottom of the drawer back. The cabinet guide members may be made of wood or of metal channels, and include laterally extending side rails which are engaged by the molded plastic drawer guide which is secured to the rear portion of the drawer. The drawer guide includes a generally rectangular flat, thin plastic body, with a flange which extends upwardly and over the outer side of the back portion of the drawer. Near the very rear of the drawer at the back of the drawer guide, it includes two laterally extending members to overly the laterally extending portions of the cabinet guide members. The plastic body also carries depending members along its length which engage the outer sides of the cabinet guides to maintain the drawer in alignment.

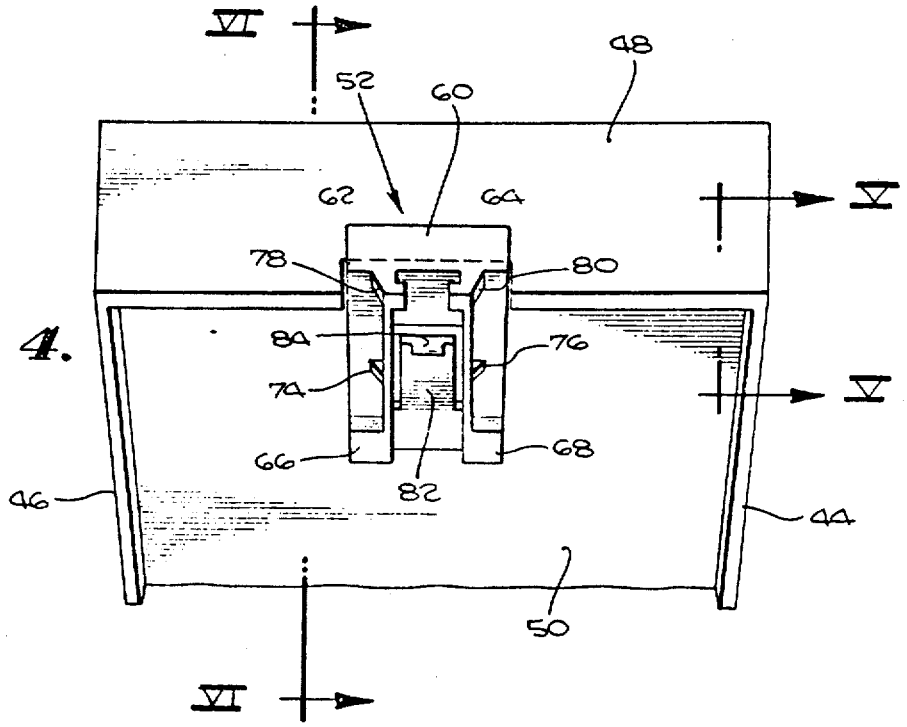

4.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-10, 16-21 is confirmed.

Claim 11 is determined to be patentable as amended.

Claims 12-15, dependent on an amended claim, are determined to be patentable.

11. An economical universal drawer slide for use with *a drawer and* a cabinet guide member having transversely extending side rails comprising:

a drawer slide body having a length which is *less than the length of the guide member and the drawer and* less than one foot;

an integral flange extending at right angles from one end of said drawer slide body for overlying the rear of the drawer to which it is to be secured;

means for securing said slide body securely to the bottom of a drawer including means for securing the rear of said slide body to the rear of a drawer;

means including two laterally extending members integrally secured to said drawer slide body for engaging the transversely extending side rails of the cabinet guide member; and means located along the length of said drawer slide body for engaging the cabinet guide member for maintaining the drawer slide member in alignment with the cabinet guide member.

* * * * *